United States Patent [19]

Champagne

[11] 4,023,747

[45] May 17, 1977

[54] YARN PACKAGE POSITIONERS FOR TEXTILE MACHINES

[75] Inventor: Ralph R. Champagne, Woonsocket, R.I.

[73] Assignee: Rockwell International Corporation, Pittsburgh, Pa.

[22] Filed: May 17, 1976

[21] Appl. No.: 687,920

[52] U.S. Cl. ..... 242/130; 242/131

[51] Int. Cl.[2] ..... B65H 49/02

[58] Field of Search ..... 242/130, 131, 131.1; 139/450, 452

[56] References Cited

UNITED STATES PATENTS

| | | | |
|---|---|---|---|
| 1,216,782 | 2/1917 | Wolf | 242/131 |
| 3,168,911 | 2/1965 | Pfarrwaller et al. | 139/450 |
| 3,674,223 | 7/1972 | Philip | 242/131 |
| 3,915,406 | 10/1975 | Rolli | 242/131 |

*Primary Examiner*—Henry S. Jaudon

[57] ABSTRACT

A yarn package positioning device for textile machines such as shuttleless looms for selectively locating the weft yarn package support spindle in the most advantageous location for withdrawing weft yarn from the package carried thereon during insertion of the weft into a warp shed. Additionally to facilitate and simplify replenishment of the weft supply the support spindle is mounted on the positioning device so that it can be manually pivoted between a donning and doffing position and the preselected position for withdrawing the weft from the yarn package.

1 Claim, 3 Drawing Figures

YARN PACKAGE POSITIONERS FOR TEXTILE MACHINES

BACKGROUND OF THE INVENTION

The invention pertains to a yarn package positioner for textile machines and, more particularly, to an improved type weft yarn package positioner for so-called shuttleless looms.

In looms of the shuttleless type, that is, those looms in which weft yarn is supplied from an outside source and is not carried to and fro through the shed by the shuttle or carrier itself, it is common practice to utilize a package positioner at one side of the loom to support and position the supply of weft from which the required amounts are withdrawn during loom operation. Package holders for shuttleless looms of the prior art performed their intended function satisfactorily; however, the means by which they are mounted in operative association with a loom and the limited versatility which they possess relative to the means for selectively locating a yarn package in operating position on a loom has initiated numerous requests for a simplified yarn package support having greater versatility in the means for selectively locating a yarn package.

A well-known form of package holder commonly utilized on shuttleless looms to which the present invention is applicable is shown and described in U.S. Pat. No. 3,165,279. This form of package holder is pivotally mounted on a fixed rail member that forms a part of a loom's framework. The package supporting spindle of this holder has limited pivotal movement between a position for assembling a cone of yarn thereon and that position where yarn is withdrawn from the package for presentation to the inserting carrier.

With the great variety of different types of weft yarns being utilized in the weaving of present day fabrics it has been found advantageous to provide a means whereby the yarn package can be selectively located in the most desirable position for weft to be withdrawn therefrom and presented to the means for its insertion into a warp shed.

As is well-known to those conversant in the art of shuttleless weaving so-called weft supply shields are carried on the loom in the area intermediate the weft supply and the elements which effect insertion of said weft into a warp shed. These shields serve to prevent weft which has a tendency to balloon as it is being withdrawn from becoming entangled with adjacent parts of the loom. The shields are provided with centrally disposed eyelets through which the weft travels as it is withdrawn. With the known types of package holders the distance between the eyelets in the shields and the yarn packages is fixed, or in other words this distance cannot be varied.

Weft yarns of low count have a much greater tendency to balloon as they are being withdrawn from their source than those classified as fine or high count yarns. For this reason and coupled with the rate of withdrawal of the weft from its source, the most advantageous location or operating position for a supply cone of weft will vary and can best be determined by the particular type of weft yarn being utilized. With some types of weft yarns preferred withdrawal control is had by locating the supply package closer to the eyelet in the shield than is possible with the conventional holders and positioners. With other types of weft a greater distance from this eyelet provides the most advantageous operating position. Additionally with some yarns it has been found that raising or lowering as well as selecting a particular angular position of the yarn package provides a very definite improvement in the control of particular types of weft as they are being withdrawn from their respective cones.

The yarn package positioner of the present invention provides a device whereby a weft yarn package can be selectively located in the most desirable position for effecting the best suited withdrawal control for all types of weft yarns.

SUMMARY OF THE INVENTION

The yarn package positioner according to the invention includes a vertically extending support rod with a clamp member selectively positionable thereon. A horizontally extending bar member is supported at one end by the clamp member and the opposite end supports a friction loaded lever which is manually pivotable and extends from said bar member in a plane normal to the axis thereof. The outer end of this lever defines clamp for selectively locating a yarn package support spindle. A spindle locating bracket is selectively positionable in a fixed position on the bar member and includes a pair of separated pin members carried thereon which extend in a plane parallel with and spaced from the axis of said bar member to positions of operative association with the yarn package support spindle. These positions limit manual movement of the support spindle between a first position for donning or doffing a yarn package therefrom and a second position whereat yarn is adapted to be withdrawn from the package. The various elements comprising the invention permit a weft yarn package to be located in the most advantageous position and regardless of the type of weft being utilized, the yarn package can be positioned to provide the desired control of said weft as it is being withdrawn from its respective cone.

It is a general object of the invention to provide an improved weft yarn package positioner for shuttleless looms of simplified construction having a minimum number of parts that are relatively inexpensive to manufacture and with long life expectancy.

A further and more specific object of the invention is to provide an improved weft yarn package positioner for shuttleless looms which regardless of the particular type of weft being utilized, is capable of locating the weft supply package in the most advantageous position which provides the best suited control of the weft as it is being withdrawn from its respective cone.

These and other objects of the invention will become more fully apparent by reference to the appended claims and as the following detailed description proceeds in reference to the figures of drawing wherein:

DESCRIPTION OF THE PREFERRED EMBODIMENT

As the general construction and operation of a loom to which the present invention is applicable is well-known and familiar to those conversant in the art, and as the invention is entirely concerned with an improved weft yarn package positioner for such looms, it is only considered necessary here to illustrate and describe those parts which are directly concerned with a preferred form of the present invention.

Figure 1:
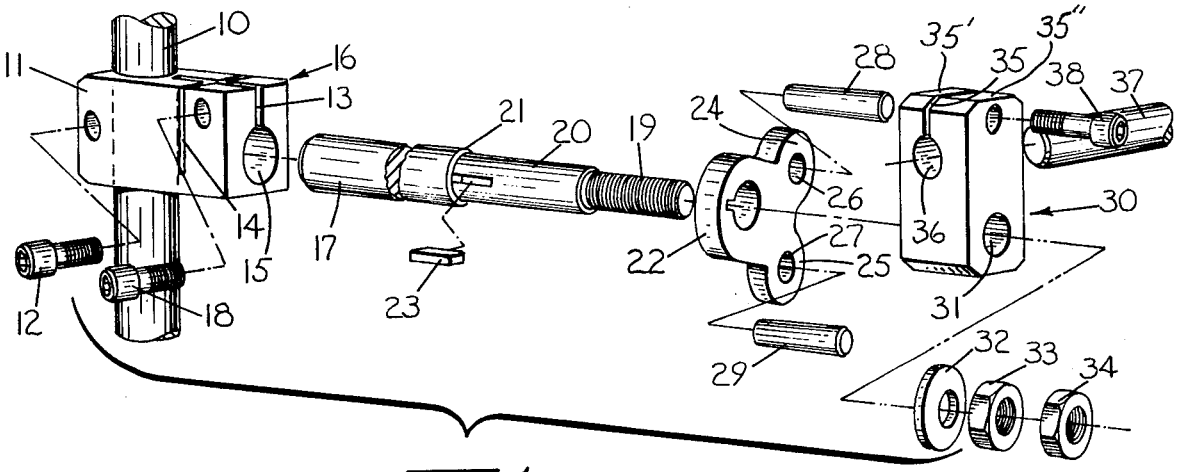
FIG. 1 is a perspective view in exploded form showing the various components comprising the invention.

In the figures of drawing a vertically extending support rod is identified by numeral 10 and is supported at its lower end by any suitable means not shown. A clamp member in the form of an elongated block 11 one end of which it selectively positionable on the support rod 10 by means of a cap screw 12. The opposite end of block 11 is slotted as at 13 and 14 (FIGS. 1 and 3) and includes a horizontally extending hole 15 the combination of which defines a clamping element indicated generally by numeral 16. That end of a bar member identified by numeral 17 in FIG. 1 is fixed in hole 15 of the clamping element 16 by means of a cap screw 18. The opposite end of this bar member is threaded for a portion of its length as at 19. That portion of the bar member intermediate its ends is depicted by numeral 20 and is of a diameter slightly less than the end 17. A shoulder 21 is formed by that portion 17 of the bar member which joins portion 20 and serves as a seat for positioning a locating bracket 22 on said bar member. This locating bracket 22 is fixed on the bar member by means of a key 23 and it extends outwardly from said bar member in a plane normal to the axis thereof. The outer portion of the locating bracket 22 terminates in a pair of spaced and integrally formed ear elements 24 and 25 having holes 26 and 27 respectively therein which extend parallel with the axis of the bar member. These holes 26 and 27 have positioning pins 28 and 29 respectively fixed therein and serve as a means for manually locating the weft package support spindle yet to be described and identified.

Immediately adjacent to the locating bracket 22 a lever member generally identified by numeral 30 is pivotally assembled by means of a mounting hole 31 on portion 20 of the bar member. Lever member 30 is retained on the bar member by means of a spring washer 32 and a pair of hex nuts 33 and 34. The spring washer applies a friction load on the lever member 30 resulting in a braking force that requires manual pivotal movement of said lever between its two available positions. The desired amount of braking force is obtained by the selective tightening of hex nut 33 and said force is maintained by tightening hex nut 34 which serves as a lock nut.

Figure 3:
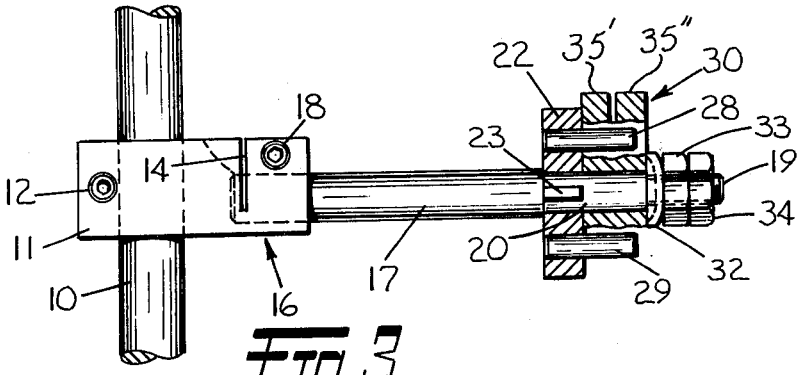
FIG. 3 is an end view and partially in section of the yarn package positioner shown in FIGS. 1 and 2.

The lever member 30 extends laterally from the axis of the bar member and its outer end is slotted as at 35 that defines a pair of opposed ear elements 35' and 35'' (FIGS. 1 and 3). Slot 35 communicates with a hole 36 located adjacent the outer end of the lever member 30 and the ear elements 35' and 35'' provide a means for clamping a yarn package support spindle 37 in said hole 36 by means of a cap screw 38.

Figure 2:
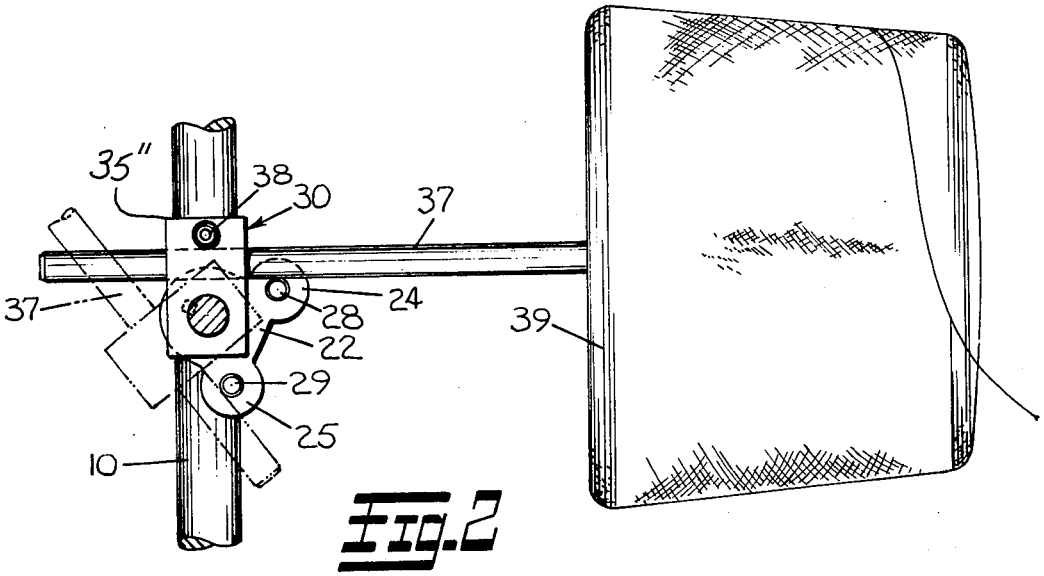
FIG. 2 is a view in side elevation showing by means of full and phantom lines the two positions between which the package supporting spindle is manually pivotable.

In FIG. 2 the weft yarn package carried on the support spindle 37 is identified by numeral 39 and in this figure of drawing the yarn package is shown in its operating position for withdrawing weft therefrom. The phantom line position of the support spindle in FIG. 2 shows that position whereat a yarn package can be donned or doffed from said spindle. In the yarn package's operating position the support spindle is caused to engage positioning pin 28 and when in the donning and doffing position is caused to engage positioning pin 29.

Although the operating position of the weft yarn package 39 is a horizontal one as shown in FIG. 2, it should be understood that the locating bracket 22 may be set in any desired position so that it will position the support spindle in the most advantageous location for facilitating withdrawal of any type weft yarn being utilized.

To summarize the operation the various elements of the yarn package positioner comprising the invention are capable of selectively locating the weft package support spindle so that the weft package carried thereon can be located in the most advantageous position for the particular type of weft being utilized. The positioner can be either raised, lowered or rotated on the support rod 10 and the horizontal bar member can be set to provide a horizontal positioning or any desired angular setting of the weft package support spindle 37. Additionally the clamping means defined by the outer end of the lever member 30 provides the means whereby the support spindle is longitudinally adjustable so that the weft package can be selectively located in close proximity with or spaced from the weft supply shield as heretofore described.

Although the present invention has been described in connection with a preferred embodiment it is to be understood that modifications and variations may be resorted to without departing from the spirit and scope of the invention as those skilled in the art will readily understand. Such modifications and variations are considered to be within the purview and scope of the invention and the appended claims.

I claim:

1. A yarn package positioner for textile machines comprising:

a. a support rod;

b. means defining a clamp member selectively positionable on said support rod;

c. a bar member having one end fixed in said clamp member and extending therefrom in a plane normal to the axis of said support rod;

d. a lever member pivotally mounted on said bar member having a pair of opposed ear elements forming a clamping means at one end thereof;

e. a yarn package support spindle supported by said clamping means; and f. a locating bracket fixed on the bar member having a pair of spaced pin members fixed therein and extending therefrom in a plane parallel with the axis of said bar member to positions of operative association with said support spindle for limiting pivotal movement of the latter between a first position for donning and doffing a yarn package therefrom and a second position for withdrawing yarn from the yarn package.

* * * * *